US011238880B2

(12) United States Patent
Cho et al.

(10) Patent No.: US 11,238,880 B2
(45) Date of Patent: Feb. 1, 2022

(54) METHOD FOR ACQUIRING NOISE-REFINED VOICE SIGNAL, AND ELECTRONIC DEVICE FOR PERFORMING SAME

(71) Applicant: Samsung Electronics Co., Ltd., Gyeonggi-do (KR)

(72) Inventors: Kiho Cho, Gyeonggi-do (KR); Hangil Moon, Gyeonggi-do (KR); Soonho Baek, Gyeonggi-do (KR); Jaemo Yang, Gyeonggi-do (KR); Beakkwon Son, Gyeonggi-do (KR); Myoungho Lee, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/959,766

(22) PCT Filed: Dec. 18, 2018

(86) PCT No.: PCT/KR2018/016092
§ 371 (c)(1),
(2) Date: Jul. 2, 2020

(87) PCT Pub. No.: WO2019/156338
PCT Pub. Date: Aug. 15, 2019

(65) Prior Publication Data

US 2020/0365168 A1 Nov. 19, 2020

(30) Foreign Application Priority Data

Feb. 12, 2018 (KR) ..... 10-2018-0016948

(51) Int. Cl.
*G10L 21/0232* (2013.01)
*G10L 25/84* (2013.01)
(Continued)

(52) U.S. Cl.
CPC ..... *G10L 21/0232* (2013.01); *G10L 25/84* (2013.01); *H04R 1/406* (2013.01); *H04R 3/005* (2013.01); *G10L 2021/02166* (2013.01)

(58) Field of Classification Search
CPC ..... G10L 21/0232; G10L 21/0208; G10L 21/0216; G10L 21/0272; G10L 21/0264;
(Continued)

(56) References Cited

U.S. PATENT DOCUMENTS 8,005,238 B2 8/2011 Tashev et al.
8,194,872 B2 6/2012 Buck et al.
(Continued)

FOREIGN PATENT DOCUMENTS

EP 1 640 971 A1 3/2006
KR 10-1597768 B1 2/2016
(Continued)

OTHER PUBLICATIONS

KR Direction-of-Arrival Estimation of Speech Signals Based on MUSIC and Reverberation Component Reduction, Journal of the Korea Institute of Information and Communication Engineering, Jun. 2014; vol. 18, No. 6, pp. 1302-1309. (http://dx.doi.org/10.6109/jkiice.2014.18.6.1302).

*Primary Examiner* — Yogeshkumar Patel
(74) *Attorney, Agent, or Firm* — Cha & Reiter, LLC

(57) ABSTRACT

According to various embodiments, an electronic device includes a plurality of microphones, and a processor electrically connected to the plurality of microphones, wherein the processor may obtain audio signals through the plurality of microphones, estimate a probability of existence of a voice signal included in the obtained audio signals, obtain correlation information between the audio signals based on the probability of existence of the voice signal and/or the obtained audio signals, obtain voice blocking information
(Continued)

based on the correlation information or a direction of arrival (DOA) estimation, obtain a first signal among the audio signals based on the audio signals, the correlation information, and the voice blocking information, obtain a second signal including the voice signal among the audio signals, and obtain a noise-removed voice signal by removing the first signal from the second signal. In addition, it is possible to implement various embodiments understood through the disclosure.

13 Claims, 10 Drawing Sheets

(51) Int. Cl.
*H04R 1/40* (2006.01)
*H04R 3/00* (2006.01)
*G10L 21/0216* (2013.01)

(58) Field of Classification Search
CPC ..... G10L 25/84; G10L 25/78; G10L 2021/02166; G10L 25/21; G10L 25/15; G10L 25/93; G10L 21/0364; G10L 2021/02165; H04R 1/406; H04R 3/005; H04R 2430/20
See application file for complete search history.

(56) References Cited

U.S. PATENT DOCUMENTS

| | | | | |
|---|---|---|---|---|
| 8,818,002 | B2 | 8/2014 | Tashev et al. | |
| 10,325,617 | B2 | 6/2019 | Yang et al. | |
| 2008/0232607 | A1* | 9/2008 | Tashev | G01S 3/86 381/71.11 |
| 2013/0083943 | A1* | 4/2013 | Sorensen | G01S 3/86 381/92 |

FOREIGN PATENT DOCUMENTS

| | | | |
|---|---|---|---|
| KR | 10-2016-0149961 | A | 12/2016 |
| KR | 10-2017-0098392 | A | 8/2017 |
| KR | 10-1811635 | B1 | 1/2018 |

* cited by examiner

METHOD FOR ACQUIRING NOISE-REFINED VOICE SIGNAL, AND ELECTRONIC DEVICE FOR PERFORMING SAME

CROSS REFERENCE TO RELATED APPLICATIONS

This application is a National Phase Entry of PCT International Application No. PCT/KR2018/016092, which was filed on Dec. 18, 2018, and claims a priority to Korean Patent Application No. 10-2018-0016948, which was filed on Feb. 12, 2018, the contents of which are incorporated herein by reference.

TECHNICAL FIELD

Embodiments of the disclosure relate to a method of obtaining a noise-removed voice signal and an electronic device performing the same.

BACKGROUND ART

With the development of information technology (IT), various types of electronic devices such as smartphones, tablet personal computers, and the like have been widely used. The electronic devices may include microphones to obtain audio signals. In an embodiment, an electronic device may include a plurality of microphones to efficiently obtain audio signals incident in various directions.

An electronic device may obtain an arbitrary audio signal as an input by using a microphone. For example, the electronic device may obtain an audio signal of a call of a user as an input, and may obtain audio signals of conversations of a plurality of users as an input. The audio signal may include a human voice and other sounds, for example, various kinds of noise such as wind noise, object hitting sounds, and the like.

DISCLOSURE

Technical Problem

A user may desire to obtain only some of arbitrary audio signals as meaningful data. For example, the user may desire to record only a conversation voice signal among conversation audio signals of a plurality of users. In this case, it may be necessary for the electronic device to remove signals, so-called noise, except for a voice signal from the arbitrary audio signal.

However, when the surrounding environment of an electronic device is changed, such as the posture and gripping state of the electronic device, the direction in which voice signals and noise are incident upon the electronic device may be changed in real time. When the electronic device does not cope with the direction of the voice signal changing according to the environmental change, the electronic device may not be able to clearly distinguish the voice signal from the noise.

In case of removing noise from an arbitrary audio signal, when the electronic device cannot clearly distinguish noise from a voice signal, some of the voice signals may be removed together with the noise. Alternatively, some of the noise may not be removed and may be included in the voice signal. In this case, the electronic device may not provide the user with some of the voice signals desired by the user, or may provide a voice signal with some of the noise. Accordingly, the user may not be able to properly obtain only the desired voice signal.

To address the above-mentioned problems and disadvantages, embodiments disclosed in the disclosure are to provide an electronic device.

Technical Solution

According to an embodiment of the disclosure, an electronic device includes a plurality of microphones, and a processor electrically connected to the plurality of microphones, wherein the processor may obtain audio signals through the plurality of microphones, estimate a probability of existence of a voice signal included in the obtained audio signals, obtain correlation information between the audio signals based on the probability of existence of the voice signal and/or the obtained audio signals, obtain voice blocking information based on the correlation information or a direction of arrival (DOA) estimation, obtain a first signal among the audio signals based on the audio signals, the correlation information, and the voice blocking information, obtain a second signal including the voice signal among the audio signals, and obtain a noise-removed voice signal by removing the first signal from the second signal.

According to another embodiment of the disclosure, a method of obtaining a noise-removed voice signal among audio signals by an electronic device includes obtaining the audio signals, estimating a probability of existence of a voice signal, obtaining correlation information based on the probability of existence of the voice signal and/or the obtained audio signals, obtaining voice blocking information based on the correlation information or a direction of arrival (DOA) estimation, obtaining a first signal among the audio signals based on the audio signals, the correlation information, and the voice blocking information, obtaining a second signal including the voice signal among the audio signals, and obtaining the noise-removed voice signal by removing the first signal from the second signal.

Advantageous Effects

According to the embodiments disclosed in the disclosure, the electronic device may adaptively obtain a voice signal desired by a user even when the surrounding environment changes. The user may obtain desired data on a voice signal from which noise is removed and of which the loss is low. In addition, various effects that are directly or indirectly understood through the disclosure may be provided.

DESCRIPTION OF DRAWINGS

With regard to description of drawings, the same or similar elements may be marked by the same or similar reference numerals.

MODE FOR INVENTION

Figure 1A:
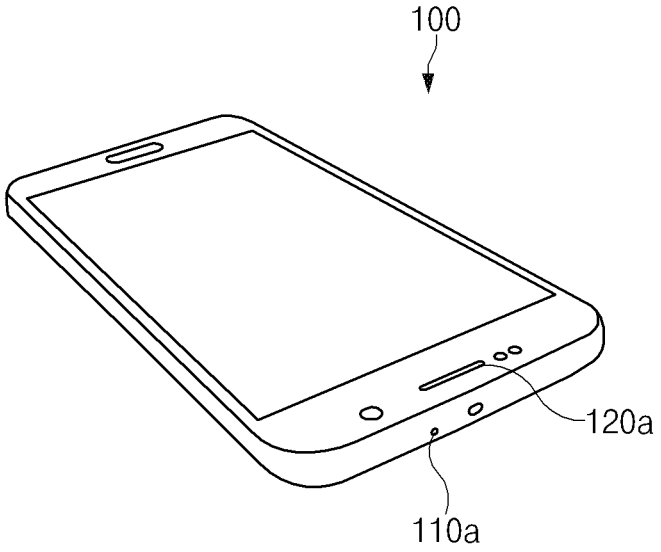
FIG. 1A illustrates a first perspective view of an electronic device including a plurality of microphones according to an embodiment.
Figure 1B:
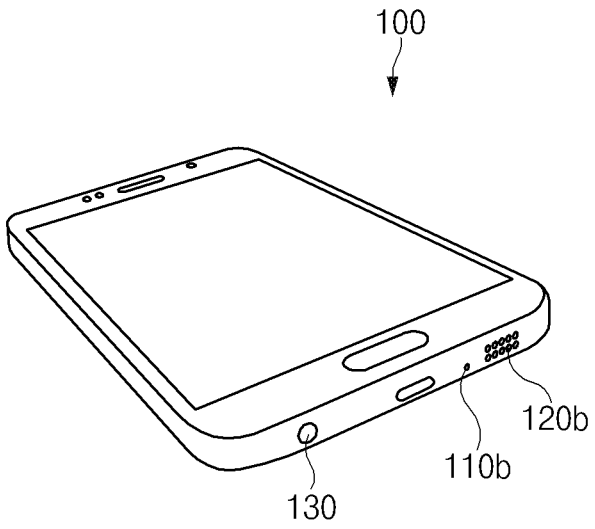
FIG. 1B is a second perspective view of an electronic device including a plurality of microphones according to an embodiment.

FIG. 1A illustrates a first perspective view of an electronic device including a plurality of microphones according to an embodiment. FIG. 1B is a second perspective view of an electronic device including a plurality of microphones according to an embodiment.

Referring to FIGS. 1A and 1B, an electronic device 100 may include a plurality of microphones 110*a* and 110*b* as input terminals. According to an embodiment, the first microphone 110*a* may be arranged on an upper end of the electronic device 100 as illustrated in FIG. 1A, and the second microphone 110*b* may be arranged on a lower end of the electronic device 100 as illustrated in FIG. 1B. According to various embodiments, the electronic device 100 may include three or more microphones different from those illustrated in FIGS. 1A and 1B. For example, the first and third microphones may be arranged on the upper end of the electronic device 100, and the second and fourth microphones may be arranged on the lower end of the electronic device 100. As another example, an external electronic device including the third microphone may be connected to the electronic device 100 illustrated in FIGS. 1A and 1B. For example, a headset including a microphone function may be connected to a sound input/output terminal 130 illustrated in FIG. 1B.

According to an embodiment, the electronic device 100 may obtain, as an input, an audio signal generated from an outside of the electronic device 100 through the plurality of microphones 110*a* and 110*b*. For example, when a plurality of users take conversation with each other, the electronic device 100 may obtain the voices of the plurality of users as inputs. As another example, the electronic device 100 may obtain an audio signal generated from another external electronic device as an input.

According to an embodiment, the electronic device 100 may obtain, as an input, an audio signal generated inside the electronic device 100 through at least some of the plurality of microphones 110*a* and 110*b*. For example, the electronic device 100 may obtain, as an input, an audio signal generated from a second speaker 120*b* included in the electronic device 100, for example, a loudspeaker through the at least some microphones. As another example, the electronic device 100 may obtain, as an input, an audio signal generated from a first speaker 120*a* of the electronic device 100, for example, a speaker (or receiver) for a voice call through the at least some microphones.

According to an embodiment, the plurality of microphones 110*a* and 110*b* may be arranged in different directions. For example, the first microphone 110*a* may be arranged upward of the electronic device 100, and the second microphone 110*b* may be arranged downward of the electronic device 100. As another example, unlike those illustrated in FIGS. 1A and 2A, the plurality of microphones 110*a* and 110*b* may be arranged toward the left or right side of the electronic device 100, respectively. According to various embodiments, an audio signal may be generated in all directions based on the electronic device 100, and a user may grip the electronic device 100 to change a posture of the electronic device 100. In this case, as described above, it may be advantageous to arrange the plurality of microphones 110*a* and 110*b* in different directions in obtaining an audio signal as an input.

According to an embodiment, the electronic device 100 may estimate a direction in which an audio signal obtained through the plurality of microphones 110*a* and 110*b* is generated. For example, when the audio signal input through the first microphone 110*a* has a greater intensity than the audio signal input through the second microphone 110*b*, the electronic device 100 may estimate that the audio signal is generated at a location closer to the first microphone 110*a* than the second microphone 110*b*. As another example, when the audio signal is input to the first microphone 110*a* earlier than the second microphone 110*b*, the electronic device 100 may estimate that the audio signal is generated at a location closer to the first microphone 110*a* than the second microphone 110*b*.

According to an embodiment, the electronic device 100 may give greater reliability to an audio signal input from some of the plurality of microphones 110*a* and 110*b* based on the estimated direction. For example, when it is estimated that the audio signal is generated at a location closer to the first microphone 110*a* than the second microphone 110*b*, the electronic device 100 may give higher reliability to the audio signal input through the first microphone 110*a* than the audio signal input through the second microphone 110*b*. For example, when a first user close to the first microphone 110*a* has a conversation with a second user close to the second microphone 110*b* while interposing the electronic device 100 therebetween, the electronic device 100 may give higher reliability to the audio signal obtained through the first microphone 110*a* than the audio signal obtained through the second microphone 110*b* for a voice signal of the first user, thereby obtaining the voice signal. The electronic device 100 may give higher reliability to the audio signal obtained through the second microphone 110*b* than the audio signal obtained through the first microphone 110*a* for a voice signal of the second user, thereby obtaining the voice signal.

According to an embodiment, the audio signal, which is obtained by the electronic device 100 as an input, may include a signal that is meaningfully provided to a user because it is of interest to the user and a signal that is meaninglessly provided to the user because it is of no interest to the user. In the disclosure, the signal that may be meaningfully provided to a user may be understood as a human voice signal. Signals other than the voice signal may be understood as noise of the audio signal.

According to an embodiment, the electronic device 100 may obtain a noise-removed voice signal from audio signals generated in all directions of the electronic device 100 and provide the obtained voice signal to a user. Hereinafter, a method of obtaining a noise-removed voice signal by the electronic device 100 will be described.

Figure 2:
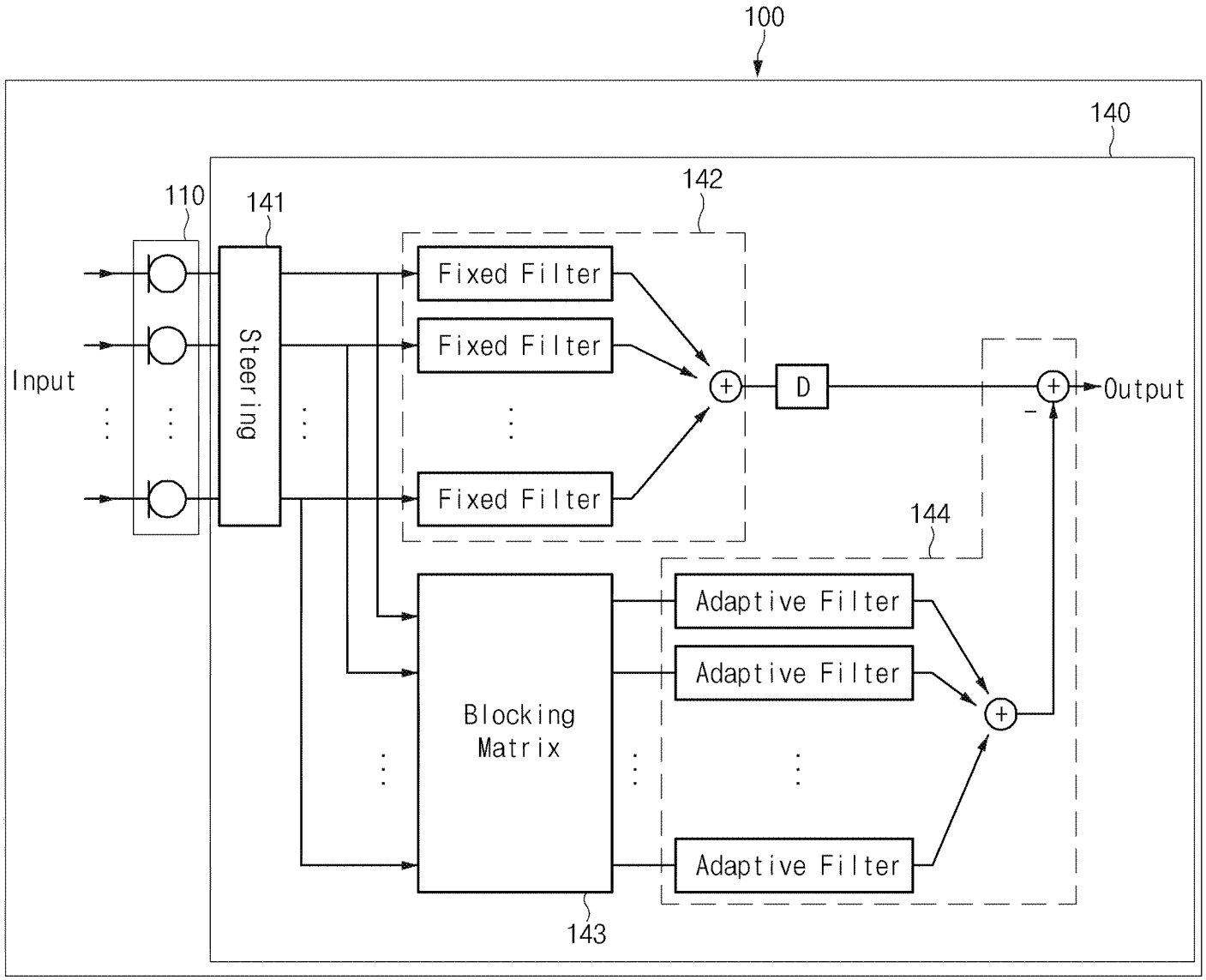
FIG. 2 is a block diagram of an electronic device illustrating a process of obtaining a noise-removed voice signal according to an embodiment.

FIG. 2 is a block diagram of an electronic device illustrating a process of obtaining a noise-removed voice signal according to an embodiment.

Referring to FIG. 2, the electronic device 100 may include a plurality of microphones 110 and a processor 140. According to various embodiments, the electronic device 100 may further include a component not shown in FIG. 2, and some of the components shown in FIG. 2 may be omitted. For example, the electronic device 100 may further include a memory capable of storing the obtained voice signal. As another example, in the electronic device 100, several of the plurality of microphones 110 illustrated in FIG. 2 may be omitted.

The plurality of microphones 110 may obtain an audio signal generated from an outside of the electronic device 100 as an input. According to an embodiment, the plurality of microphones 110 may be arranged while being spaced apart from each other. In this case, each microphone may have a different distance or direction from the location where the audio signal is generated. The audio signals obtained from each microphone may have different intensities and may be input at different times. According to an embodiment, the audio signals obtained through the plurality of microphones 110 may be transmitted to the processor 140.

The processor 140 may process the audio signals received from the plurality of microphones 110 to generate desired signals. Referring to FIG. 2, a process of processing audio signals received at the processor 140 will be illustrated. The processor 140 may include a plurality of modules that process the audio signals. According to an embodiment, the processor 140 may include a steering module 141, a filter module 142, a blocking module 143, and a canceler module 144. In the disclosure, it may be understood that the operations performed by the modules are always operated by the processor 140.

According to an embodiment, the steering module 141 may adjust a time difference of audio signals received from each microphone. For example, a first audio signal obtained through a first microphone may be input earlier than a second audio signal obtained through a second microphone. In this case, the steering module 141 may align the time axes of the first and second audio signals equally. According to an embodiment, audio signals passing through the steering module 141 may be transmitted to the filter module 142 and the blocking module 143, respectively.

According to an embodiment, the filter module 142 may obtain a second signal with an improved signal-noise ratio (SNR) of a received audio signal by using a plurality of filters. For example, the filter module 142 may pass only signals in a frequency range (e.g., 50 Hz to 8,000 Hz) that correspond to a human voice among audio signals. The filter module 142 may transmit the second signal to the canceler module 144. In an embodiment, the second signal may include a voice signal.

According to an embodiment, the blocking module 143 may be a module that blocks a voice signal among received audio signals to obtain only noise. For example, the blocking module 143 may obtain a first signal including only noise among the audio signals.

According to an embodiment, the blocking module 143 may estimate the existence probability of a voice signal in the received audio signals. The existence probability of the voice signal may be estimated in a range of 0 to 1. For example, the existence probability of the voice signal may be estimated by a complex Gaussian mixture model (CGMM) based estimation scheme.

In an embodiment, the blocking module 143 may obtain estimated voice signals and estimated noise signals from the estimated existence probability of the estimated voice signal and the received audio signals. For example, the estimated voice signal may be obtained by multiplying the audio signals and the existence probability of the voice signal, and the estimated noise signal may be obtained by subtracting the estimated voice signal from the audio signals.

According to an embodiment, the blocking module 143 may obtain correlation information for at least some of the received audio signals based on the existence probability of the voice signal and/or the obtained audio signals.

For example, the blocking module 143 may obtain correlation information for the received audio signals based on the obtained audio signals.

As another example, the blocking module 143 may obtain correlation information of estimated voice signals among the audio signals based on the estimated voice signals obtained based on the existence probability of the voice signal and the obtained audio signals. As still another example, the blocking module 143 may obtain correlation information of estimated noise signals among the audio signals based on the estimated noise signals obtained based on the existence probability of the voice signal and the obtained audio signals.

According to an embodiment, the correlation information may be understood as association, similarity, or the like between signals obtained through each microphone among the plurality of microphones 110. For example, the association or similarity may be calculated by a covariance matrix between a plurality of signals. For example, when the plurality of microphones 110 includes first and second microphones, the correlation information may be association or similarity between a signal obtained through the first microphone and a signal obtained through the second microphone. In an embodiment, the correlation information may be calculated by a covariance matrix between the signal obtained through the first microphone and the signal obtained through the second microphone.

According to an embodiment, the correlation information may include a covariance matrix between audio signals corresponding to each microphone. As another embodiment, the correlation information may include a covariance matrix between estimated voice signals corresponding to each microphone. As still another embodiment, the correlation information may include a covariance matrix between estimated noise signals corresponding to each microphone.

According to an embodiment, the blocking module 143 may obtain voice blocking information based on the correlation information. For example, the blocking module 143 may obtain the voice blocking information based on the covariance matrix between estimated voice signals. As another example, the blocking module 143 may obtain the voice blocking information based on the covariance matrix between estimated noise signals. In the disclosure, the voice blocking information may be understood as a null vector that blocks voice signal components incident in a specific direction.

According to another embodiment, the blocking module 143 may obtain voice blocking information based on a direction of arrival (DOA) estimation. The DOA estimation may be understood as estimating the direction in which a voice signal is incident. According to an embodiment, the DOA estimation may be performed by a time difference of arrival (TDOA) scheme which estimates through a difference in time for a voice signal to reach each microphone. When the direction in which the voice signal is incident is estimated by the DOA estimation, a null vector that blocks the voice signal component, so-called voice blocking information, may be obtained.

As described above, when voice blocking information is obtained based on the correlation information or DOA estimation, even if the posture of the electronic device 100 or the gripping state of the user changes, the electronic device 100 may obtain voice blocking information adaptively suitable to the change.

According to an embodiment, the blocking module 143 may obtain a first signal among the audio signals based on audio signals, correlation information, and voice blocking information. According to an embodiment, the blocking module 143 may obtain a blocking matrix based on the correlation information and voice blocking information, and may obtain the first signal by applying the blocking matrix to the audio signals. In an embodiment, the blocking module 143 may transmit the first signal to the canceler module 144.

According to an embodiment, the obtained first signal may be a signal which the electronic device 100 adaptively obtains only noise among audio signals even when a posture of the electronic device 100 or a gripping state of a user changes.

According to an embodiment, the canceler module 144 may include a plurality of filters. The canceler module 144 may use the plurality of filters and obtain a noise-removed voice signal among audio signals based on the first and second signals. For example, the canceler module 144 may remove components of the first signal from the second signal. Because the second signal includes a voice signal and noise, and the first signal includes only noise, the canceler module 144 may obtain a noise-removed voice signal by removing the first signal from the second signal. Because the first signal is noise in consideration of a change in the posture of the electronic device 100 or the gripping state of the user, the voice signal may be a signal of which noise is effectively removed.

Figure 3:
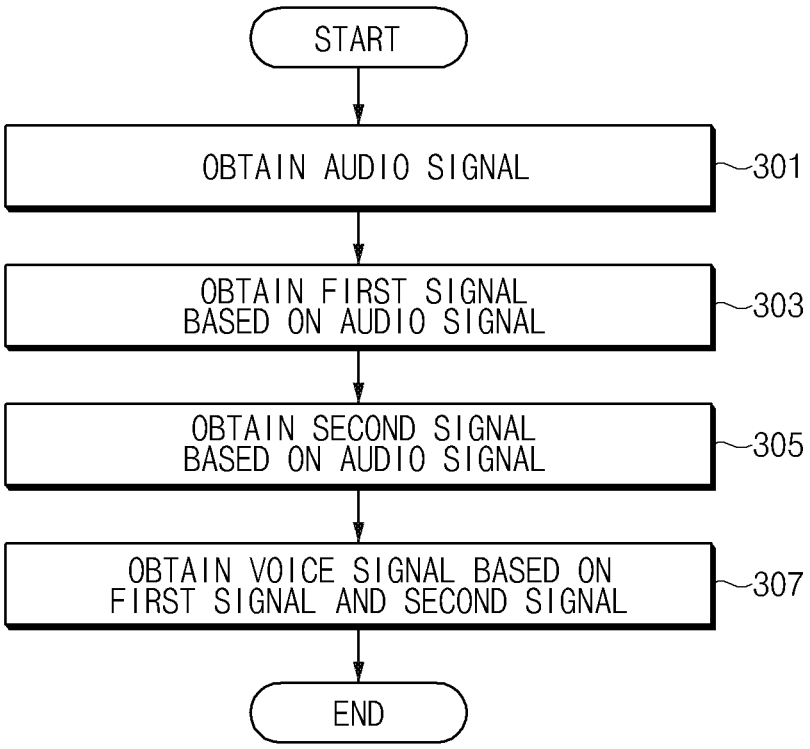
FIG. 3 is a flowchart illustrating an operation of obtaining a noise-removed voice signal by an electronic device according to an embodiment.

FIG. 3 is a flowchart illustrating an operation of obtaining a noise-removed voice signal by an electronic device according to an embodiment.

Referring to FIG. 3, an operation in which the electronic device 100 obtains a noise-removed voice signal may include operations 301 to 307.

In operation 301, the electronic device 100 may obtain an audio signal. In an embodiment, the electronic device 100 may include the plurality of microphones 110 and obtain an audio signal through the plurality of microphones 110. The audio signal may be transmitted from the plurality of microphones 110 to the processor 140.

In operation 303, the electronic device 100 may obtain a first signal based at least on the audio signal obtained in operation 301. In an embodiment, the first signal may be a noise signal which is obtained by blocking a voice signal from the audio signal. The first signal may be obtained by the blocking module 143 of the processor 140. In an embodiment, the first signal may be obtained in consideration of a change in the posture of the electronic device 100 or the gripping state of the user.

In operation 305, the electronic device 100 may obtain a second signal based at least on the audio signal obtained in operation 301. In an embodiment, the second signal may be a signal which is obtained by improving a signal-to-noise ratio of the audio signal through a plurality of filters. The second signal may include a voice signal and at least some noise. The second signal may be obtained by the filter module 142 of the processor 140. According to an embodiment, operations 303 and 305 may be performed in reverse order or simultaneously. In other words, the electronic device 100 may obtain the first signal through operation 303 after obtaining the second signal through operation 305, or perform operations 303 and 305 simultaneously to obtain the first and second signals simultaneously.

In operation 307, the electronic device 100 may obtain a voice signal based on the first and second signals. The voice signal may be a voice signal which is refined by removing noise in the audio signal obtained in operation 301. According to an embodiment, the voice signal may be obtained by removing the first signal obtained in operation 303 from the second signal obtained in operation 305. The voice signal may be obtained by the canceler module 144 of the processor 140.

Figure 4:
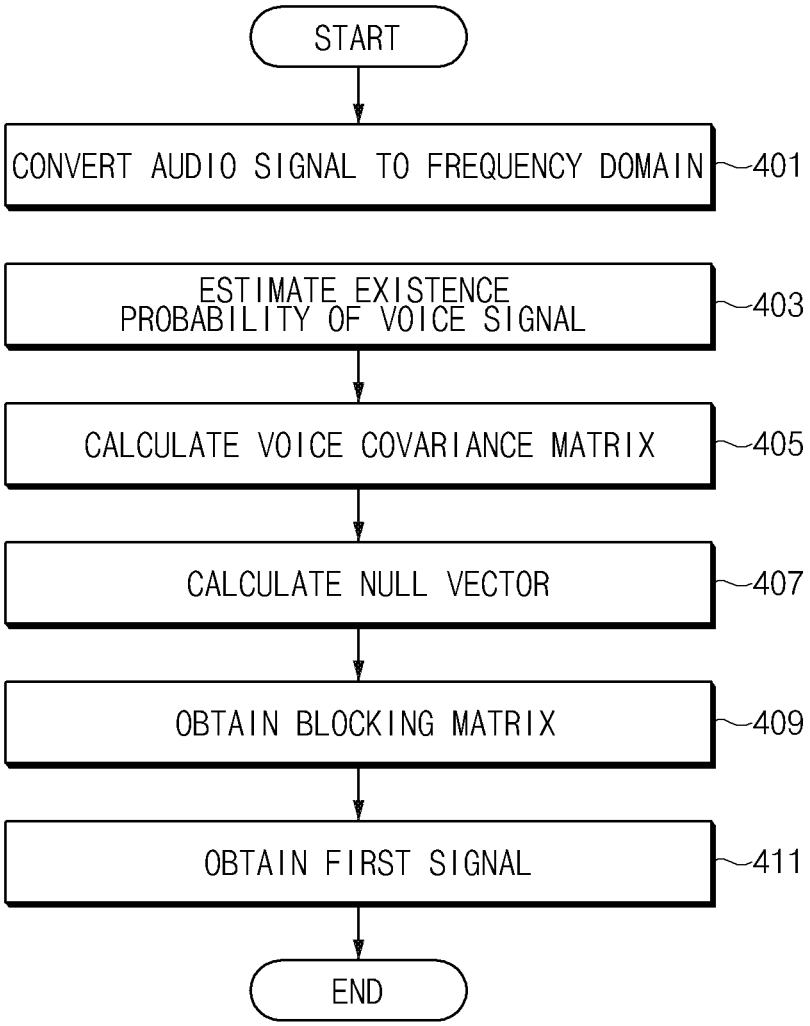
FIG. 4 is a flowchart illustrating an operation of obtaining a first signal by an electronic device according to an embodiment.

FIG. 4 is a flowchart illustrating an operation of obtaining a first signal by an electronic device according to an embodiment.

Referring to FIG. 4, an operation in which the electronic device 100 obtains a first signal may include operations 401 to 411.

In operation 401, the electronic device 100 may convert the obtained audio signal from the time domain to the frequency domain. For example, the audio signal may be transformed from the time domain to the frequency domain by a Fourier transform, for example, a short time Fourier transform (STFT).

In operation 403, the electronic device 100 may estimate the existence probability of a voice signal from the converted audio signal. The existence probability of the voice signal may be estimated in a range of 0 to 1. For example, the existence probability of a voice signal may be estimated by a complex Gaussian mixture model (CGMM) based estimation scheme.

In operation 405, the electronic device 100 may calculate a covariance matrix between estimated voice signals calculated from audio signals obtained from each microphone. The estimated voice signals may be respectively calculated as a product of an audio signal obtained from each microphone and a existence probability of the voice signal. In the disclosure, the covariance matrix between the estimated voice signals may be referred to as a voice covariance matrix.

According to an embodiment, the size of the voice covariance matrix may vary with the number of microphones included in the electronic device 100. For example, when there are two microphones, because two estimated voice signals are obtained, the voice covariance matrix may be represented by a 2 by 2 matrix. As another example, when there are M microphones, because M estimated voice signals are obtained, the covariance matrix may be represented by an M by M matrix.

In operation 407, the electronic device 100 may calculate a null vector based on a covariance matrix between the estimated voice signals calculated in operation 405, a so-called voice covariance matrix. The null vector may be understood as vectors constituting a null space for blocking a signal in a specific direction.

According to an embodiment, when M microphones are included in the electronic device 100, the electronic device 100 may calculate (M−1) null vectors by using the first column of the voice covariance matrix. For example, when $R_s(n, k)$ represents the voice covariance matrix for the n-th frame and the k-th frequency signal of the audio signal, the first component of the i-th null vector among the (M−1) null vectors may be expressed as—$R_s(n, k)_{(i,1)}/R_s(n, k)_{(1,1)}$, the (i+1)-th component may be '1', and the remaining components may be '0'.

In operation 409, the electronic device 100 may obtain a blocking matrix based on the voice covariance matrix calculated in operation 405 and the null vector calculated in operation 407. For example, when the blocking matrix has a plurality of columns, the i-th column $\vec{b}_i(n, k)$ of the blocking matrix is the negative covariance matrix $R_s(n, k)$, and the i-th null vector of the null vector is $\hat{h}_i(n, k)$, the blocking matrix may be expressed as $(R_s(n, k)^{-1}\hat{h}_i(n, k))/(\hat{h}_i(n, k)^H R_s(n, k)^{-1}\hat{h}_i(n, k)$. According to an embodiment, the blocking matrix may be obtained by using a covariance matrix between the audio signals corresponding to each microphone, a so-called input covariance matrix, instead of the voice covariance matrix.

In operation 411, the electronic device 100 may obtain a first signal by applying the audio signals obtained through the plurality of microphones 110 to the blocking matrix obtained in operation 409. For example, the electronic device 100 may obtain the first signal by calculating an inner product of the audio signal and the blocking matrix.

Figure 5:
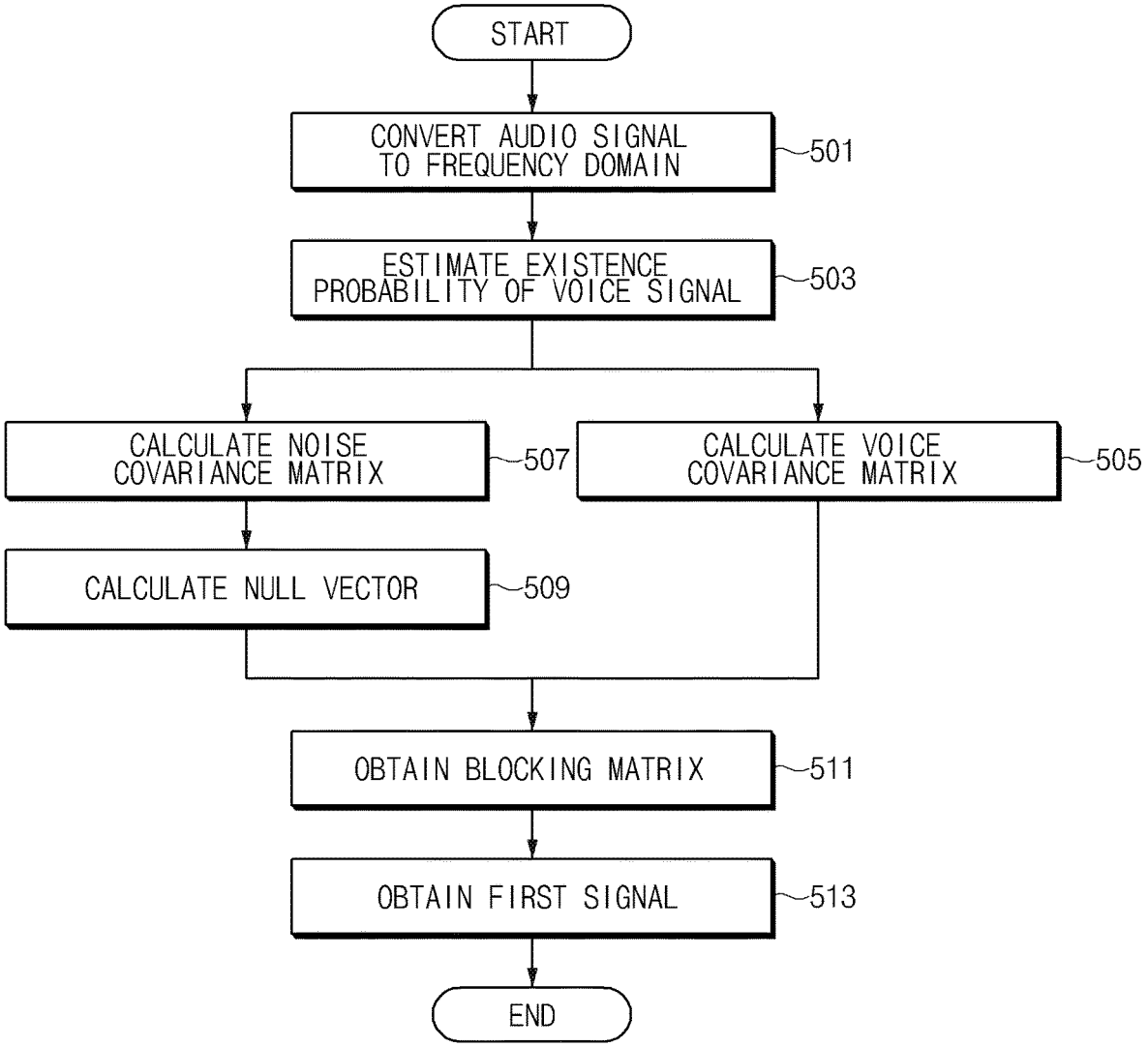
FIG. 5 is a flowchart illustrating an operation of obtaining a first signal by an electronic device according to another embodiment.

FIG. 5 is a flowchart illustrating an operation of obtaining a first signal by an electronic device according to another embodiment.

Referring to FIG. 5, an operation in which the electronic device 100 obtains a first signal may include operations 501 to 513. In the description of FIG. 5, descriptions overlapping with those of FIG. 4 may be omitted. For example, operations 501 to 505 may be the same as or similar to operations 401 to 405 of FIG. 4, and operations 511 to 513 may be the same as or similar to operations 409 to 411 of FIG. 4.

In operation 501, the electronic device 100 may convert the obtained audio signal from the time domain to the frequency domain.

In operation 503, the electronic device 100 may estimate the existence probability of a voice signal from the converted audio signal.

In operation 505, the electronic device 100 may calculate a covariance matrix between the estimated voice signals. In the disclosure, the covariance matrix between the estimated voice signals may be referred to as a voice covariance matrix.

In operation 507, the electronic device 100 may calculate a covariance matrix between the estimated noise signals. According to an embodiment, the estimated noise signals may be calculated by obtaining differences between an audio signal obtained from each microphone and the estimated voice signals. The estimated voice signals may be calculated by multiplying the audio signal and the existence probability of the voice signal. In the disclosure, the covariance matrix between the estimated noise signals may be referred to as a noise covariance matrix.

In operation 509, the electronic device 100 may calculate a null vector based on a covariance matrix between the estimated noise signals calculated in operation 507, a so-called noise covariance matrix. The null vector may be understood as vectors constituting a null space for blocking a signal in a specific direction.

According to an embodiment, when M microphones are included in the electronic device 100, the electronic device 100 may calculates M null vectors by using 1 to M-th columns of the noise covariance matrix. For example, each i-th column vector obtained by dividing each component by a component (i, i) for each i-th column in the noise covariance matrix may be obtained as the null vector.

According to another embodiment, when M microphones are included in the electronic device 100, the electronic device 100 may calculate M eigen vectors for the noise covariance matrix to obtain each eigen vector as the null vector.

In operation 511, the electronic device 100 may obtain a blocking matrix based on the voice covariance matrix calculated in operation 507 and the null vector calculated in operation 509.

In operation 513, the electronic device 100 may obtain the first signal by applying the audio signals obtained through the plurality of microphones 110 to the blocking matrix obtained in operation 509.

Figure 6:
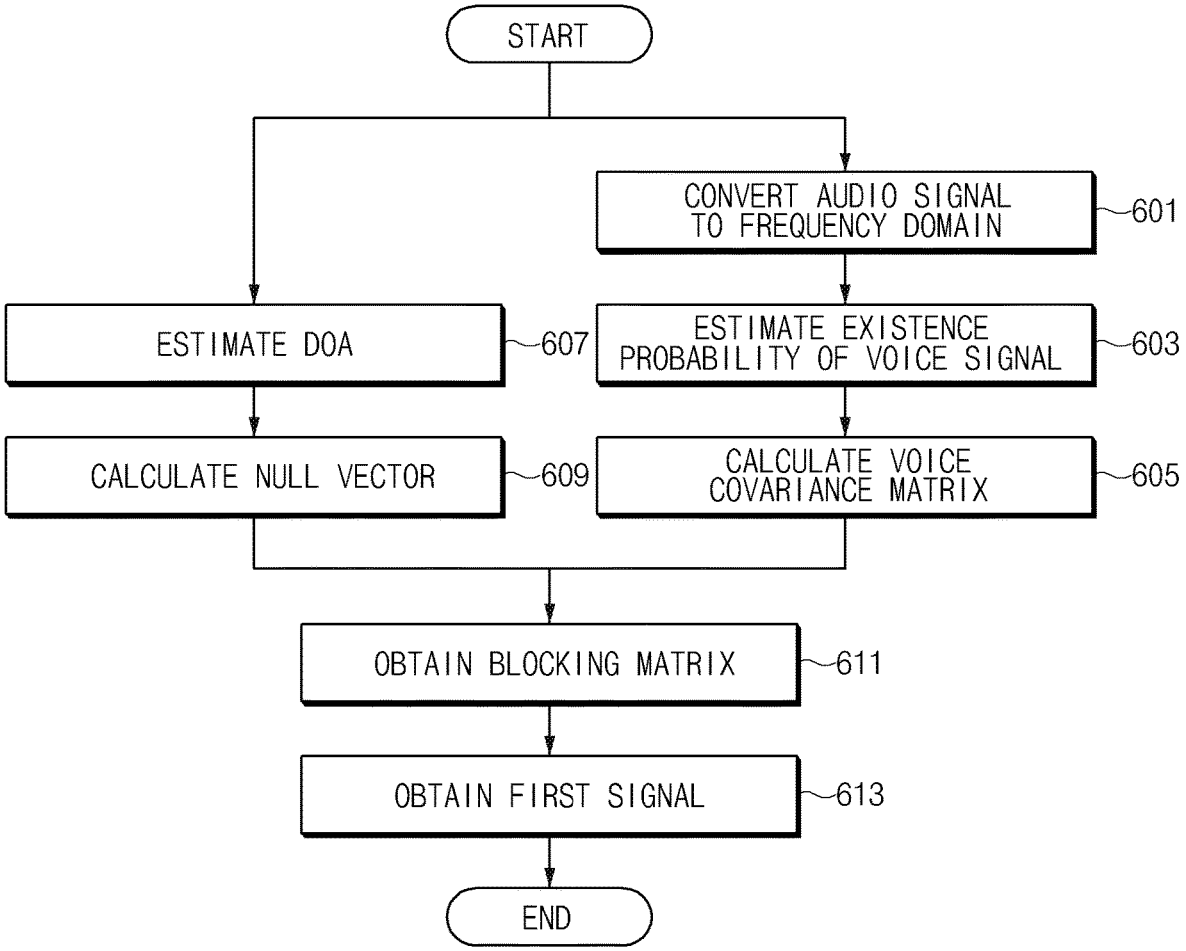
FIG. 6 is a flowchart illustrating an operation of obtaining a first signal by an electronic device according to still another embodiment.

FIG. 6 is a flowchart illustrating an operation of obtaining a first signal by an electronic device according to still another embodiment.

Referring to FIG. 6, an operation in which the electronic device 100 obtains a first signal may include operations 601 to 613. In the description of FIG. 6, descriptions overlapping with those of FIG. 4 may be omitted. For example, operations 601 to 605 may be the same as or similar to operations 401 to 405 of FIG. 4, and operations 611 to 613 may be the same as or similar to operations 409 to 411 of FIG. 4.

In operation 601, the electronic device 100 may convert the obtained audio signal from the time domain to the frequency domain.

In operation 603, the electronic device 100 may estimate the existence probability of a voice signal from the converted audio signal.

In operation 605, the electronic device 100 may calculate a covariance matrix between the estimated voice signals. In this document, the covariance matrix between the estimated voice signals may be referred to as a voice covariance matrix.

In operation 607, the electronic device 100 may perform a DOA estimation by using the audio signals obtained through the plurality of microphones 110. The DOA estimation may be understood as estimating the direction in which a voice signal is incident. According to an embodiment, the DOA estimation may be performed by a time difference of arrival (TDOA) scheme which estimates through a difference in time for a voice signal to reach each microphone.

For example, when a plurality of microphones includes the first microphone to the third microphone, the voice signal may reach the second microphone after reaching the first microphone first, and finally reach the third microphone. In this case, the electronic device 100 may estimate a direction in which the voice signal is incident based on a difference in time at which the voice signal arrives at each microphone and a speed of the voice signal, and calculate a voice incidence direction vector indicating the incident direction.

According to an embodiment, when the difference between the arrival times of the first microphone and the m-th microphone is $\tau_m$, the voice incidence direction vector corresponding to the k-th frequency in the n-th frame of the audio signal may be expressed as $$\left(1, \exp\left(\frac{j2\pi k\tau_2}{K}\right), \ldots, \exp\left(\frac{j2\pi k\tau_M}{K}\right)\right).$$

Where 'K' may mean a short-time Fourier transform (STFT) length of the audio signal.

In operation 609, the electronic device 100 may calculate a null vector based on the voice incident direction vector calculated in operation 607.

According to an embodiment, when M microphones are included in the electronic device 100, the electronic device 100 may calculate (M−1) null vectors by using the voice incident direction vector. For example, the first component of the i-th null vector of the (M−1) null vectors may be expressed as −exp $$\left(-\frac{j2\pi k\tau_{i+1}}{K}\right),$$

the (i+1)-th component may be '1', and the remaining components may be zero.

In operation 611, the electronic device 100 may obtain a blocking matrix based on the voice covariance matrix calculated in operation 605 and the null vector calculated in operation 609.

In operation 613, the electronic device 100 may obtain the first signal by applying the audio signals obtained through the plurality of microphones 110 to the blocking matrix obtained in operation 611.

Figure 7:
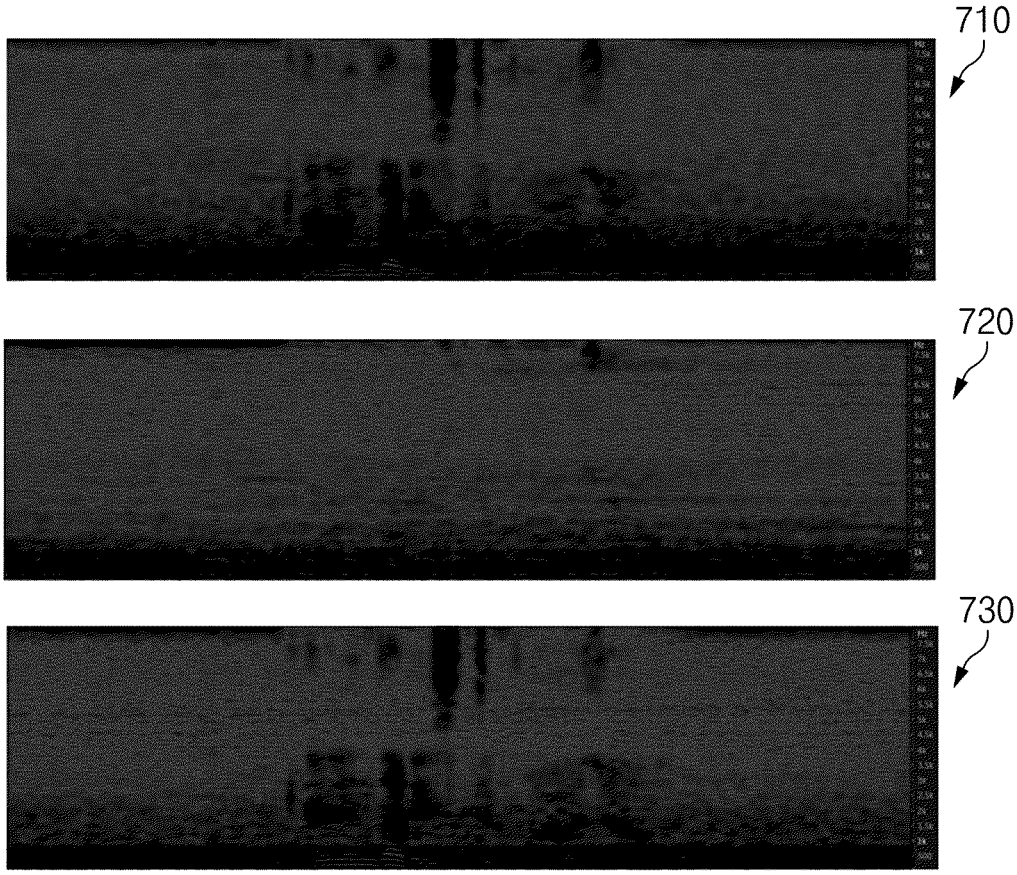
FIG. 7 is a spectrum graph of a signal obtained by an electronic device according to an embodiment.

FIG. 7 is a spectrum graph of a signal obtained by an electronic device according to an embodiment.

Referring to FIG. 7, a first spectrum graph 710, a second spectrum graph 720, and a third spectrum graph 730 are illustrated. According to an embodiment, the first spectrum graph 710 may represent an audio signal obtained through the plurality of microphones 110 by the electronic device 100. The second spectrum graph 720 may represent a first signal corresponding to noise. The third spectrum graph 730 may represent a voice signal which the electronic device 100 refines by removing noise. The x-axis of the spectrum graphs 710, 720 and 730 may represent time, and the y-axis may represent frequency.

According to an embodiment, the spectrum graphs 710, 720 and 730 may be understood as the results of simulations in which an audio signal is obtained through two microphones and the first signal is obtained by the scheme illustrated in FIG. 5.

Referring to the first and third spectrum graphs 710 and 730, it may be identified that noise is removed from a low-frequency region at the bottom of the graph. It may be identified that the low-frequency region at the bottom of the graph appears as noise in the second spectrum graph 720.

It may be identified through the spectrum graphs 710, 720 and 730 illustrated in FIG. 7 that an electronic device obtains a voice signal which is refined by removing noise from an audio signal.

Figure 8:
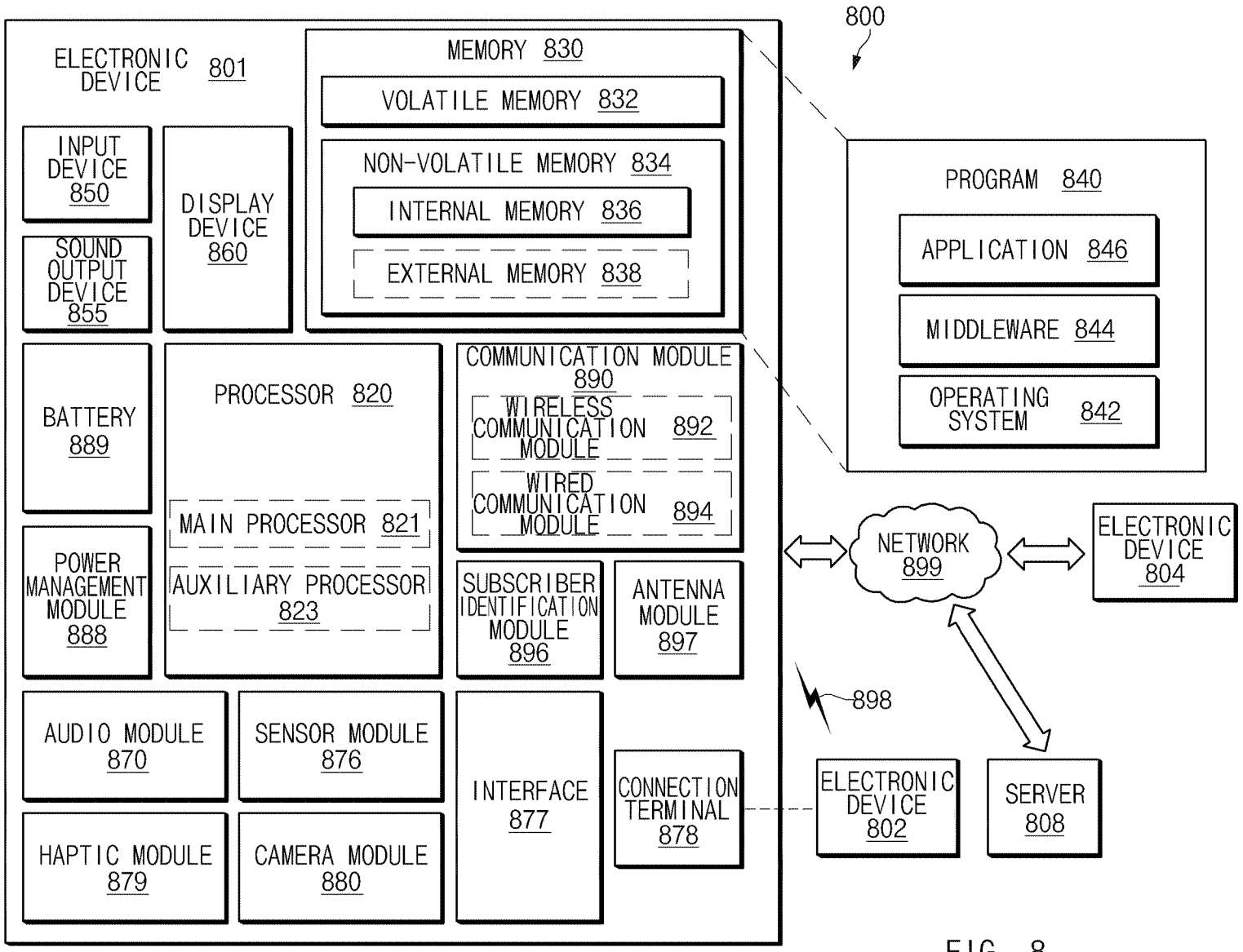
FIG. 8 is a block diagram of an electronic device in a network environment according to various embodiments.

FIG. 8 is a block diagram of an electronic device in a network environment according to various embodiments.

Referring to FIG. 8, an electronic device 801 may communicate with an electronic device 802 through a first network 898 (e.g., a short-range wireless communication) or may communicate with an electronic device 804 or a server 808 through a second network 899 (e.g., a long-distance wireless communication) in a network environment 800. According to an embodiment, the electronic device 801 may communicate with the electronic device 804 through the server 808. According to an embodiment, the electronic device 801 may include a processor 820, a memory 830, an input device 850, a sound output device 855, a display device 860, an audio module 870, a sensor module 876, an interface 877, a haptic module 879, a camera module 880, a power management module 888, a battery 889, a communication module 890, a subscriber identification module 896, and an antenna module 897. According to some embodiments, at least one (e.g., the display device 860 or the camera module 880) among components of the electronic device 801 may be omitted or other components may be added to the electronic device 801. According to some embodiments, some components may be integrated and implemented as in the case of the sensor module 876 (e.g., a fingerprint sensor, an iris sensor, or an illuminance sensor) embedded in the display device 860 (e.g., a display).

The processor 820 may operate, for example, software (e.g., a program 840) to control at least one of other components (e.g., a hardware or software component) of the electronic device 801 connected to the processor 820 and may process and compute a variety of data. The processor 820 may load a command set or data, which is received from other components (e.g., the sensor module 876 or the communication module 890), into a volatile memory 832, may process the loaded command or data, and may store result data into a nonvolatile memory 834. According to an embodiment, the processor 820 may include a main processor 821 (e.g., a central processing unit or an application processor) and an auxiliary processor 823 (e.g., a graphic processing device, an image signal processor, a sensor hub processor, or a communication processor), which operates independently from the main processor 821, additionally or alternatively uses less power than the main processor 821, or is specified to a designated function. In this case, the auxiliary processor 823 may operate separately from the main processor 821 or embedded.

In this case, the auxiliary processor 823 may control, for example, at least some of functions or states associated with at least one component (e.g., the display device 860, the sensor module 876, or the communication module 890) among the components of the electronic device 801 instead of the main processor 821 while the main processor 821 is in an inactive (e.g., sleep) state or together with the main processor 821 while the main processor 821 is in an active (e.g., an application execution) state. According to an embodiment, the auxiliary processor 823 (e.g., the image signal processor or the communication processor) may be implemented as a part of another component (e.g., the camera module 880 or the communication module 890) that is functionally related to the auxiliary processor 823. The memory 830 may store a variety of data used by at least one component (e.g., the processor 820 or the sensor module 876) of the electronic device 801, for example, software (e.g., the program 840) and input data or output data with respect to commands associated with the software. The memory 830 may include the volatile memory 832 or the nonvolatile memory 834.

The program 840 may be stored in the memory 830 as software and may include, for example, an operating system 842, a middleware 844, or an application 846.

The input device 850 may be a device for receiving a command or data, which is used for a component (e.g., the processor 820) of the electronic device 801, from an outside (e.g., a user) of the electronic device 801 and may include, for example, a microphone, a mouse, or a keyboard.

The sound output device 855 may be a device for outputting a sound signal to the outside of the electronic device 801 and may include, for example, a speaker used for general purposes, such as multimedia play or recordings play, and a receiver used only for receiving calls. According to an embodiment, the receiver and the speaker may be either integrally or separately implemented.

The display device 860 may be a device for visually presenting information to the user of the electronic device 801 and may include, for example, a display, a hologram device, or a projector and a control circuit for controlling a corresponding device. According to an embodiment, the display device 860 may include a touch circuitry or a pressure sensor for measuring an intensity of pressure on the touch.

The audio module 870 may convert a sound and an electrical signal in dual directions. According to an embodiment, the audio module 870 may obtain the sound through the input device 850 or may output the sound through an external electronic device (e.g., the electronic device 802 (e.g., a speaker or a headphone)) wired or wirelessly connected to the sound output device 855 or the electronic device 801.

The sensor module 876 may generate an electrical signal or a data value corresponding to an operating state (e.g., power or temperature) inside or an environmental state outside the electronic device 801. The sensor module 876 may include, for example, a gesture sensor, a gyro sensor, a barometric pressure sensor, a magnetic sensor, an acceleration sensor, a grip sensor, a proximity sensor, a color sensor, an infrared sensor, a biometric sensor, a temperature sensor, a humidity sensor, or an illuminance sensor.

The interface 877 may support a designated protocol wired or wirelessly connected to the external electronic device (e.g., the electronic device 802). According to an embodiment, the interface 877 may include, for example, an HDMI (high-definition multimedia interface), a USB (universal serial bus) interface, an SD card interface, or an audio interface.

A connecting terminal 878 may include a connector that physically connects the electronic device 801 to the external electronic device (e.g., the electronic device 802), for example, an HDMI connector, a USB connector, an SD card connector, or an audio connector (e.g., a headphone connector).

The haptic module 879 may convert an electrical signal to a mechanical stimulation (e.g., vibration or movement) or an electrical stimulation perceived by the user through tactile or kinesthetic sensations. The haptic module 879 may include, for example, a motor, a piezoelectric element, or an electric stimulator.

The camera module 880 may shoot a still image or a video image. According to an embodiment, the camera module 880 may include, for example, at least one lens, an image sensor, an image signal processor, or a flash.

The power management module 888 may be a module for managing power supplied to the electronic device 801 and may serve as at least a part of a power management integrated circuit (PMIC).

The battery 889 may be a device for supplying power to at least one component of the electronic device 801 and may include, for example, a non-rechargeable (primary) battery, a rechargeable (secondary) battery, or a fuel cell.

The communication module 890 may establish a wired or wireless communication channel between the electronic device 801 and the external electronic device (e.g., the electronic device 802, the electronic device 804, or the server 808) and support communication execution through the established communication channel. The communication module 890 may include at least one communication processor operating independently from the processor 820 (e.g., the application processor) and supporting the wired communication or the wireless communication. According to an embodiment, the communication module 890 may include a wireless communication module 892 (e.g., a cellular communication module, a short-range wireless communication module, or a GNSS (global navigation satellite system) communication module) or a wired communication module 894 (e.g., an LAN (local area network) communication module or a power line communication module) and may communicate with the external electronic device using a corresponding communication module among them through the first network 898 (e.g., the short-range communication network such as a Bluetooth, a WiFi direct, or an IrDA (infrared data association)) or the second network 899 (e.g., the long-distance wireless communication network such as a cellular network, an internet, or a computer network (e.g., LAN or WAN)). The above-mentioned various communication modules 890 may be implemented into one chip or into separate chips, respectively.

According to an embodiment, the wireless communication module 892 may identify and authenticate the electronic device 801 using user information stored in the subscriber identification module 896 in the communication network.

The antenna module 897 may include one or more antennas to transmit or receive the signal or power to or from an external source. According to an embodiment, the communication module 890 (e.g., the wireless communication module 892) may transmit or receive the signal to or from the external electronic device through the antenna suitable for the communication method.

Some components among the components may be connected to each other through a communication method (e.g., a bus, a GPIO (general purpose input/output), an SPI (serial peripheral interface), or an MIPI (mobile industry processor interface)) used between peripheral devices to exchange signals (e.g., a command or data) with each other.

According to an embodiment, the command or data may be transmitted or received between the electronic device 801 and the external electronic device 804 through the server 808 connected to the second network 899. Each of the electronic devices 802 and 804 may be the same or different types as or from the electronic device 801. According to an embodiment, all or some of the operations performed by the electronic device 801 may be performed by another electronic device or a plurality of external electronic devices. When the electronic device 801 performs some functions or services automatically or by request, the electronic device 801 may request the external electronic device to perform at least some of the functions related to the functions or services, in addition to or instead of performing the functions or services by itself. The external electronic device receiving the request may carry out the requested function or the additional function and transmit the result to the electronic device 801. The electronic device 801 may provide the requested functions or services based on the received result as is or after additionally processing the received result. To this end, for example, a cloud computing, distributed computing, or client-server computing technology may be used.

Figure 9:
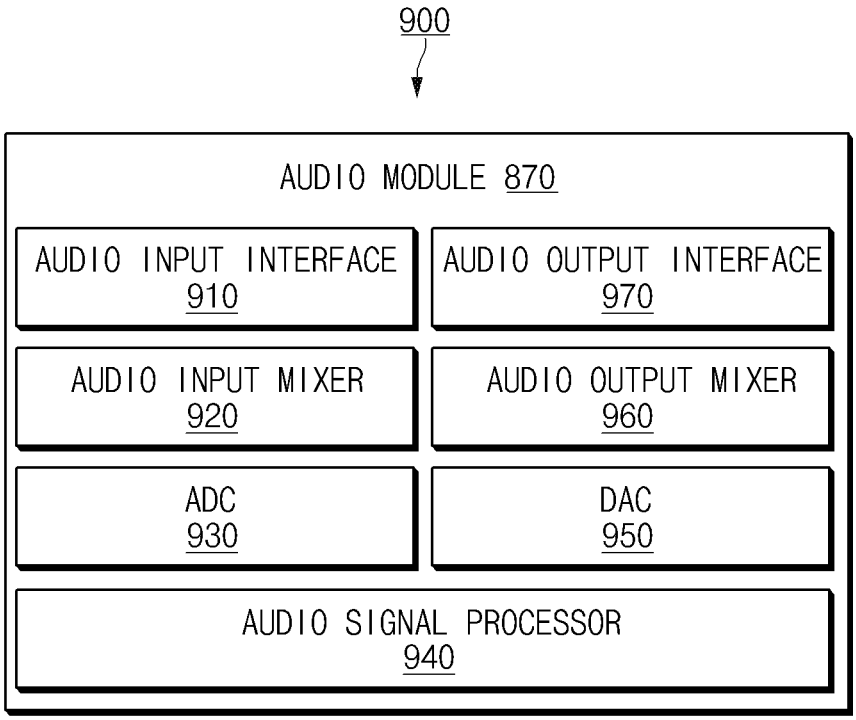
FIG. 9 is a block diagram 900 illustrating the audio module 870 according to various embodiments.

FIG. 9 is a block diagram 900 illustrating the audio module 870 according to various embodiments. Referring to FIG. 9, the audio module 870 may include, for example, an audio input interface 910, an audio input mixer 920, an analog-to-digital converter (ADC) 930, an audio signal processor 940, a digital-to-analog converter (DAC) 950, an audio output mixer 960, or an audio output interface 970.

The audio input interface 910 may receive an audio signal corresponding to a sound obtained from the outside of the electronic device 801 via a microphone (e.g., a dynamic microphone, a condenser microphone, or a piezo microphone) that is configured as part of the input device 850 or separately from the electronic device 801. For example, if an audio signal is obtained from the external electronic device 802 (e.g., a headset or a microphone), the audio input interface 910 may be connected with the external electronic device 802 directly via the connecting terminal 878, or wirelessly (e.g., Bluetooth™ communication) via the wireless communication module 892 to receive the audio signal. According to an embodiment, the audio input interface 910 may receive a control signal (e.g., a volume adjustment signal received via an input button) related to the audio signal obtained from the external electronic device 802. The audio input interface 910 may include a plurality of audio input channels and may receive a different audio signal via a corresponding one of the plurality of audio input channels, respectively. According to an embodiment, additionally or alternatively, the audio input interface 910 may receive an audio signal from another component (e.g., the processor 820 or the memory 830) of the electronic device 801.

The audio input mixer 920 may synthesize a plurality of inputted audio signals into at least one audio signal. For example, according to an embodiment, the audio input mixer 920 may synthesize a plurality of analog audio signals inputted via the audio input interface 910 into at least one analog audio signal.

The ADC 930 may convert an analog audio signal into a digital audio signal. For example, according to an embodiment, the ADC 930 may convert an analog audio signal received via the audio input interface 910 or, additionally or alternatively, an analog audio signal synthesized via the audio input mixer 920 into a digital audio signal.

The audio signal processor 940 may perform various processing on a digital audio signal received via the ADC 930 or a digital audio signal received from another component of the electronic device 801. For example, according to an embodiment, the audio signal processor 940 may perform changing a sampling rate, applying one or more filters, interpolation processing, amplifying or attenuating a whole or partial frequency bandwidth, noise processing (e.g., attenuating noise or echoes), changing channels (e.g., switching between mono and stereo), mixing, or extracting a specified signal for one or more digital audio signals. According to an embodiment, one or more functions of the audio signal processor 940 may be implemented in the form of an equalizer.

The DAC 950 may convert a digital audio signal into an analog audio signal. For example, according to an embodiment, the DAC 950 may convert a digital audio signal processed by the audio signal processor 940 or a digital audio signal obtained from another component (e.g., the processor (820) or the memory (830)) of the electronic device 801 into an analog audio signal.

The audio output mixer 960 may synthesize a plurality of audio signals, which are to be outputted, into at least one audio signal. For example, according to an embodiment, the audio output mixer 960 may synthesize an analog audio signal converted by the DAC 950 and another analog audio signal (e.g., an analog audio signal received via the audio input interface 910) into at least one analog audio signal.

The audio output interface 970 may output an analog audio signal converted by the DAC 950 or, additionally or alternatively, an analog audio signal synthesized by the audio output mixer 960 to the outside of the electronic device 801 via the sound output device 855. The sound output device 855 may include, for example, a speaker, such as a dynamic driver or a balanced armature driver, or a receiver. According to an embodiment, the sound output device 855 may include a plurality of speakers. In such a case, the audio output interface 970 may output audio signals having a plurality of different channels (e.g., stereo channels or 5.1 channels) via at least some of the plurality of speakers. According to an embodiment, the audio output interface 970 may be connected with the external electronic device 802 (e.g., an external speaker or a headset) directly via the connecting terminal 878 or wirelessly via the wireless communication module 892 to output an audio signal.

According to an embodiment, the audio module 870 may generate, without separately including the audio input mixer 920 or the audio output mixer 960, at least one digital audio signal by synthesizing a plurality of digital audio signals using at least one function of the audio signal processor 940.

According to an embodiment, the audio module 870 may include an audio amplifier (not shown) (e.g., a speaker amplifying circuit) that is capable of amplifying an analog audio signal inputted via the audio input interface 910 or an audio signal that is to be outputted via the audio output interface 970. According to an embodiment, the audio amplifier may be configured as a module separate from the audio module 870.

According to the embodiments disclosed in the disclosure, the electronic device may adaptively obtain a voice signal desired by a user even when the surrounding environment changes. The user may obtain the desired data on a voice signal from which noise is removed and of which the loss is low.

The electronic device according to various embodiments disclosed in the present disclosure may be various types of devices. The electronic device may include, for example, at least one of a portable communication device (e.g., a smartphone), a computer device, a portable multimedia device, a mobile medical appliance, a camera, a wearable device, or a home appliance. The electronic device according to an embodiment of the present disclosure should not be limited to the above-mentioned devices.

It should be understood that various embodiments of the present disclosure and terms used in the embodiments do not intend to limit technologies disclosed in the present disclosure to the particular forms disclosed herein; rather, the present disclosure should be construed to cover various modifications, equivalents, and/or alternatives of embodiments of the present disclosure. With regard to description of drawings, similar components may be assigned with similar reference numerals. As used herein, singular forms may include plural forms as well unless the context clearly indicates otherwise. In the present disclosure disclosed herein, the expressions "A or B", "at least one of A or/and B", "A, B, or C" or "one or more of A, B, or/and C", and the like used herein may include any and all combinations of one or more of the associated listed items. The expressions "a first", "a second", "the first", or "the second", used in herein, may refer to various components regardless of the order and/or the importance, but do not limit the corresponding components. The above expressions are used merely for the purpose of distinguishing a component from the other components. It should be understood that when a component (e.g., a first component) is referred to as being (operatively or communicatively) "connected," or "coupled," to another component (e.g., a second component), it may be directly connected or coupled directly to the other component or any other component (e.g., a third component) may be interposed between them.

The term "module" used herein may represent, for example, a unit including one or more combinations of hardware, software and firmware. The term "module" may be interchangeably used with the terms "logic", "logical block", "part" and "circuit". The "module" may be a minimum unit of an integrated part or may be a part thereof. The "module" may be a minimum unit for performing one or more functions or a part thereof. For example, the "module" may include an application-specific integrated circuit (ASIC).

Various embodiments of the present disclosure may be implemented by software (e.g., the program 840) including an instruction stored in a machine-readable storage media (e.g., an internal memory 836 or an external memory 838) readable by a machine (e.g., a computer). The machine may be a device that calls the instruction from the machine-readable storage media and operates depending on the called instruction and may include the electronic device (e.g., the electronic device 801). When the instruction is executed by the processor (e.g., the processor 820), the processor may perform a function corresponding to the instruction directly or using other components under the control of the processor. The instruction may include a code generated or executed by a compiler or an interpreter. The machine-readable storage media may be provided in the form of non-transitory storage media. Here, the term "non-transitory", as used herein, is a limitation of the medium itself (i.e., tangible, not a signal) as opposed to a limitation on data storage persistency.

According to an embodiment, the method according to various embodiments disclosed in the present disclosure may be provided as a part of a computer program product. The computer program product may be traded between a seller and a buyer as a product. The computer program product may be distributed in the form of machine-readable storage medium (e.g., a compact disc read only memory (CD-ROM)) or may be distributed only through an application store (e.g., a Play Store™). In the case of online distribution, at least a portion of the computer program product may be temporarily stored or generated in a storage medium such as a memory of a manufacturer's server, an application store's server, or a relay server.

Each component (e.g., the module or the program) according to various embodiments may include at least one of the above components, and a portion of the above sub-components may be omitted, or additional other sub-components may be further included. Alternatively or additionally, some components (e.g., the module or the program) may be integrated in one component and may perform the same or similar functions performed by each corresponding components prior to the integration. Operations performed by a module, a programming, or other components according to various embodiments of the present disclosure may be executed sequentially, in parallel, repeatedly, or in a heuristic method. Also, at least some operations may be executed in different sequences, omitted, or other operations may be added.

While the present disclosure has been shown and described with reference to various embodiments thereof, it will be understood by those skilled in the art that various changes in form and details may be made therein without departing from the spirit and scope of the present disclosure as defined by the appended claims and their equivalents.

The invention claimed is:

1. An electronic device comprising:

a plurality of microphones; and a processor electrically connected to the plurality of microphones, wherein the processor is configured to:

obtain audio signals through the plurality of microphones, estimate a probability of existence of a voice signal included in the obtained audio signals, obtain estimated voice signals based on the audio signals and the probability of existence of the voice signal, obtain correlation information between the audio signals based on the probability of existence of the voice signal and/or the obtained audio signals, wherein the correlation information includes a covariance matrix between the estimated voice signals that correspond to the plurality of microphones, respectively, obtain voice blocking information based on the correlation information or a direction of arrival (DOA) estimation, obtain a first signal among the audio signals based on the audio signals, the correlation information, and the voice blocking information, obtain a second signal including the voice signal among the audio signals, and obtain a noise-removed voice signal by removing the first signal from the second signal.

2. The electronic device of claim 1, wherein the processor is configured to:

obtain a blocking matrix based on the correlation information and the voice blocking information, and obtain the first signal based on the audio signals and the blocking matrix.

3. The electronic device of claim 1, wherein the correlation information includes a covariance matrix between the audio signals that correspond to the plurality of microphones, respectively.

4. The electronic device of claim 1, wherein the processor is configured to obtain the voice blocking information based on the covariance matrix between the estimated voice signals.

5. The electronic device of claim 4, wherein the processor is configured to obtain the voice blocking information based on a column vector of the covariance matrix between the estimated voice signals.

6. The electronic device of claim 1, wherein the processor is configured to:

obtain estimated noise signals based on the audio signals and the probability of existence of the voice signal, and obtain the voice blocking information based on a covariance matrix between the estimated noise signals.

7. The electronic device of claim 6, wherein the processor is configured to obtain the voice blocking information based on an eigen vector of the covariance matrix between the estimated noise signals.

8. The electronic device of claim 6, wherein the processor is configured to obtain the voice blocking information based on a column vector of the covariance matrix between the estimated noise signals.

9. The electronic device of claim 1, wherein the processor is configured to perform the direction of arrival estimation based on at least a difference between times taken for the voice signal to reach the plurality of microphones.

10. A method of obtaining a noise-removed voice signal among audio signals by an electronic device, the method comprising:

obtaining the audio signals;

estimating a probability of existence of a voice signal;

obtaining estimated voice signals based on the audio signals and the probability of existence of the voice signal;

obtaining correlation information based on the probability of existence of the voice signal and/or the obtained audio signals, wherein the correlation information includes a covariance matrix between the estimated voice signals that correspond to a plurality of microphones, respectively;

obtaining voice blocking information based on the correlation information or a direction of arrival (DOA) estimation;

obtaining a first signal among the audio signals based on the audio signals, the correlation information, and the voice blocking information;

obtaining a second signal including the voice signal among the audio signals; and obtaining the noise-removed voice signal by removing the first signal from the second signal.

11. The method of claim 10, wherein the obtaining of the first signal includes:

obtaining a blocking matrix based on the correlation information and the voice blocking information; and obtaining the first signal based on the audio signals and the blocking matrix.

12. The method of claim 10, wherein the obtaining of the correlation information includes:

obtaining a covariance matrix between the audio signals.

13. The method of claim 10, wherein the obtaining of the voice blocking information includes:

obtaining the voice blocking information based on the covariance matrix between the estimated voice signals.

* * * * *